US005803077A

United States Patent [19]

Gazzara

[11] Patent Number: 5,803,077

[45] Date of Patent: Sep. 8, 1998

[54] MASK WITH ELASTIC WEBBING

[75] Inventor: Peter J. Gazzara, Reading, Mass.

[73] Assignee: Procare, Inc., Woburn, Mass.

[21] Appl. No.: 529,700

[22] Filed: Sep. 15, 1995

[51] Int. Cl.[6] ..... A62B 7/10

[52] U.S. Cl. ..... 128/205.27; 128/206.13; 128/207.11

[58] Field of Search ..... 128/205.27, 205.28, 128/205.29, 206.13, 206.19, 207.11; 2/206

[56] References Cited

U.S. PATENT DOCUMENTS

| | | | |
|---|---|---|---|
| 1,292,095 | 1/1919 | Schwartz | 128/206.19 |
| 2,248,477 | 7/1941 | Lombard | 128/206.13 |
| 3,603,315 | 9/1971 | Becker, III . | |
| 3,802,429 | 4/1974 | Bird . | |
| 3,834,394 | 9/1974 | Raines . | |
| 3,971,369 | 7/1976 | Aspelin et al. . | |
| 4,355,637 | 10/1982 | Dyer . | |
| 4,720,415 | 1/1988 | Vander Wielen et al. . | |
| 4,802,473 | 2/1989 | Hubbard et al. . | |
| 4,827,923 | 5/1989 | Bishop et al. | 128/207.11 |
| 5,226,992 | 7/1993 | Morman . | |
| 5,265,280 | 11/1993 | Walsh | 2/206 |
| 5,316,837 | 5/1994 | Cohen . | |
| 5,366,793 | 11/1994 | Fitts, Jr. et al. | 428/198 |
| 5,385,775 | 1/1995 | Wright . | |
| 5,400,780 | 3/1995 | Nishino | 128/205.27 |

*Primary Examiner*—Aaron J. Lewis
*Attorney, Agent, or Firm*—Choate, Hall & Stewart

[57] ABSTRACT

A face mask and a method for producing a face mask that includes a cover material adapted for disposal over a portion of the face of a wearer and at least one band made of a hypoallergenic, anisotropic composite elastic material, wherein the band is attached to the cover material so as to firmly, yet comfortably, secure the mask to the face of the wearer.

29 Claims, 3 Drawing Sheets

MASK WITH ELASTIC WEBBING

BACKGROUND OF THE INVENTION

The present invention pertains to face masks.

Face masks may be attached to the face of the wearer by various methods, including adhesive strips, straps that tie together behind the head, and elastic that loops behind the head or around the ears. Comfort, ease of donning and a secure attachment to the face are three of the primary criteria for judging the quality of a face mask. The latter criterion is especially critical to face masks that function to prevent the spread of contaminants, both to and from the wearer, for example, surgical masks. A further criterion of face masks that has heretofore not been addressed in the prior art is that face masks be constructed of hypoallergenic materials. Lastly, in certain environments, for example, the operating room, where serious harm may result by wearing contaminated face masks, it is essential that face masks be disposed of after only one usage. The manufacturing costs of such face masks must therefore be low, so that consumers can purchase large quantities of the masks at an affordable price.

The present art consists of face masks that do not satisfactorily meet all of these criteria, particularly with regard to surgical masks. The traditional type of surgical mask has ties attached to both sides of the mask that tie together behind the wearer's head. This type of mask is difficult to don, often requiring the assistance of another person. Since medical personnel frequently encounter life-threatening situations where speed is of the utmost importance, time lost to securing such masks is a significant problem. Furthermore, surgical masks that tie tend to become loose and sometimes unfasten entirely, which can result in contamination of the surgical field. Lastly, in order to prevent unfastening, medical personnel often tie the straps together so tightly that the mask is uncomfortable.

While masks with adhesive strips and elastic bands can be easily and quickly donned, neither of these types of masks are comfortable. Adhesive is painful to remove from the skin and elastic bands tend to consist of thin, tight straps that press into the skin. Furthermore, during long periods of wear, the pressure from elastic straps secured around the head or the ears can cause headaches. Elastic ear loops also result in skin irritation behind the ears because the elastic rubs and presses into this especially soft area of the skin. Lastly, masks secured by elastic straps tend to pucker along the sides of the wearer's face, particularly along the cheekbone, leaving openings through which contaminants can enter and exit.

Another problem involves the composition and properties of elastics. First of all, elastic often includes latex, a hyperallergenic material that has long been the source of complaints by the medical community. Secondly, elastics for securing masks tend to be isotropic—that is, the elastics stretch in more than one direction, such that the different stretching directions are not independent from each other. Anisotropic elastics, on the other hand, tend to stretch in only one direction.

For example, stretching the length of an anisotropic elastic will not result in any substantial decrease in its width. Pulling an isotropic elastic to a greater length, however, causes its width to significantly decrease. Because masks secured with elastic bands tend to be isotropic, the end result is a thinner band that presses into the wearer's skin.

Lastly, although materials with some of the properties desirable for securing face masks, for example, softness and resistance to elongation, exist, the high cost of manufacturing these materials precludes using them to produce disposable, affordable face masks.

The lack of an anisotropic elastic composition, appropriate for securing face masks, has thus far prevented the development of more comfortable, functionable masks. Thus, a need exists for an affordable face mask that attaches comfortably, yet firmly, to a wearer's face with non-latex, anisotropic elastic.

SUMMARY OF THE INVENTION

In light of the limitations of face masks discussed above, it is the objective of the present invention to produce a face mask that is hypoallergenic, fits securely, yet comfortably, is easy to don, and is also inexpensive and therefore disposable.

The present invention disclosed herein comprises a face mask and a method for forming a face mask that fills this need. The apparatus includes a cover designed to cover a portion of a wearer's face in order to prevent the spread of contaminants. The mask further includes at least one band made of elastic webbing designed to secure the mask to a wearer's face.

The face mask of the present invention overcomes the drawbacks of the prior art in several ways. First of all, the elastic webbing is an anisotropic composite elastic that has a high degree of resistance to elongation, a property essential for ensuring a secure attachment to a wearer's face. The nature of the elastic webbing also prevents the mask from puckering and forming openings along the sides of the wearer's face, where contaminants can enter and exit. This risk is eliminated for a couple of reasons: first, the anisotropic elastic stretches in only one direction—in this case, away from the wearer's face; second, the composite elastic webbing may be formed in wide strips. This greater width allows the composite elastic to exert a pulling force over a larger area of the mask than is typical. Thus, the perimeter of the mask is pulled properly around the wearer's face, rather than sagging or puckering. Furthermore, because the elastic webbing stretches in only one direction, it does not thin out after prolonged use. Thus, the advantage of the greater width is not lost after long periods of wear.

Secondly, the composite elastic of the present invention is both hypoallergenic and comfortable. It is soft and thus, does not press into the wearer's skin. Its high resistance to elongation eliminates the need to pull the elastic so tightly that it creates pressure around the head or ears.

In addition, because the mask of the present invention is secured to the wearer's face with elastic webbing, rather than ties, it can be quickly and easily donned without assistance—whether this involves complete removal or conveniently hanging it around the neck for later use.

Lastly, the cost of technology of the face mask is very low. Therefore, the mask can be sold in large quantities at an affordable price.

The present patent application specifically describes and illustrates an embodiment in which a material covering the wearer's nose and mouth is secured to the wearer's face by an upper and a lower band of the composite elastic material, wherein the bands are attached to the right and left sides of the mask so as to encircle the wearer's head, creating a firm yet comfortable fit. The cover material of this embodiment has at least one pleat formed therein, designed to expand in the center when worn. The mask includes reinforcing side seams and, at the top of the mask, a semi-rigid horizontal fabric-enclosed member for molding against the wearer's nose and facial features, thereby forming a seal to prevent the spread of contaminants.

However, this invention is not limited to any particular embodiment. For example, this invention is not limited to a particular number of bands or straps, a particular shape of bands or straps, attachments of the bands or straps to particular locations on the cover material, a particular method of attaching the bands or straps to the cover material, a particular fabric comprising the cover material, a particular design of the cover material, or a particular method of making the composite elastic material comprising the bands or straps. Alternative embodiments concerning the bands or straps may include face masks secured to the wearer's face by bands that loop around the ears, encircle the top of the head, and criss-cross in the back of the head, for example.

DETAILED DESCRIPTION OF THE PREFERRED EMBODIMENT

Figure 1:
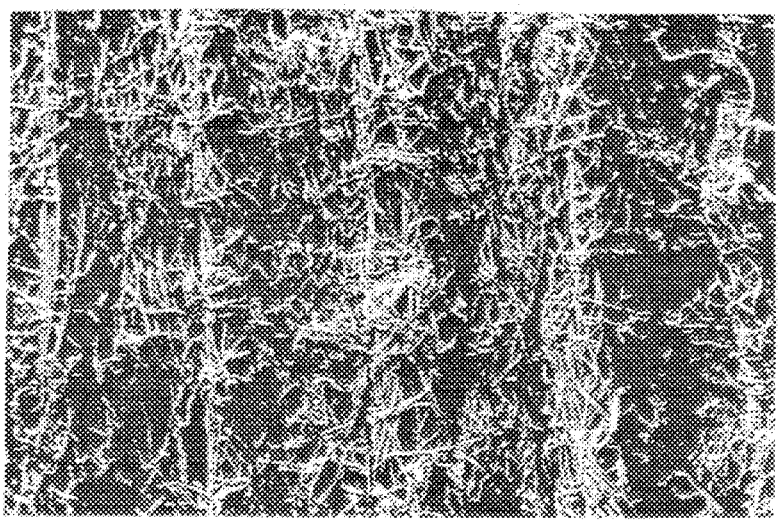
FIG. 1 is a photomicrograph of an exemplary anisotropic elastic fibrous web which is a component of the composite elastic material of the present invention.

The present invention comprises a face mask that attaches to the wearer's face by a hypoallergenic, anisotropic composite elastic material and a method for making a face mask as such. The composite elastic material is comprised substantially of anisotropic elastic fibrous webbing and a gatherable material, with at least one layer of the gatherable material joined to at least one layer of the anisotropic elastic fibrous webbing at spaced-apart locations so that the gatherable layer is gathered between the spaced-apart locations.

The gatherable layer may be a variety of materials, so long as it is gatherable and can be joined to the anisotropic elastic fibrous webbing in a manner that maintains the anisotropic elastic nature of the webbing. For example, the gatherable layer may comprise a single type of fiber or a mixture of fibers, including, for example, spunbonded fibers, meltblown fibers or a bonded carded web of fibers. The gatherable layer may also comprise a mixture of fibers and one or more other materials, such as particulates or wood pulp.

The anisotropic elastic fibrous webbing comprises at least one layer of elastomeric fibers and at least one layer of substantially parallel rows of elastomeric filaments. The elastomeric fibers and elastomeric filaments may be made from any material which may be manufactured into such fibers and filaments. Generally, any suitable elastomeric fiber-forming resins or blends containing the same may be utilized for the elastomeric fibers and any suitable elastomeric filament-forming resins or blends containing the same may be utilized for the elastomeric filaments. The fibers and filaments may be formed from the same or different elastomeric resin. For example, the fibers and filaments may comprise one or more elastomeric polymers, such as polyesters, polyurethanes, polyamides, copolymers of ethylene and at least one vinyl monomer, and A-B-A' block copolymers wherein A and A' are the same or different polymer, and wherein B is an elastomeric polymer block.

The elastomeric fibers may also comprise a mixture of elastomeric polymers and one or more other materials, for example, wood pulp, particulates, superabsorbent materials and nonelastic fibers, such as polyester fibers, polyamide fibers, glass fibers, polyolefin fibers, cellulosic derived fibers, multi-component fibers, natural fibers and absorbent fibers. Examples of particulate materials include activated charcoal, clays, starches and metal oxides.

The method of manufacturing the face mask substantially comprises the following steps: manufacturing the anisotropic elastic fibrous webbing and the gatherable material, joining at least one gatherable layer to at least one layer of anisotropic elastic fibrous webbing to form the composite elastic material, manufacturing a cover material adapted for disposal over the nostrils and mouth of the wearer to prevent the spread of contamination, forming two headbands from the composite elastic material for securing the cover material to the wearer's face, and attaching the headbands to the cover material.

The elastomeric filaments and the elastomeric fibers of the anisotropic elastic fibrous webbing may be manufactured by a variety of extrusion techniques. The composite elastic material is formed by depositing the extruded fibers and the extruded filaments onto a surface so that, prior to bonding between the filaments and the fibers, the filaments form substantially parallel rows on the surface and the fibers are dispersed at a substantially uniform density on the surface. This method can be carried out by either depositing the extruded filaments first and then depositing the extruded fibers onto the filaments or vice versa. To form a continuous sheet of the composite material, the extruded filaments and fibers are deposited by stationary equipment onto a moving surface.

The elastomeric fibers and the elastomeric filaments may bond wholly autogenously, partially autogenously, or non-autogenously. For example, where bonding occurs partially autogenously or non-autogenously, bonding may be improved or accomplished through the addition of tackifying resins to the filament-forming and/or fiber-forming compositions, prior to extrusion. In addition to any heat which may be applied during extrusion, heat, as well as pressure, may be applied to the elastomeric fibers and filaments after deposition to improve or to accomplish bonding. One skilled in the art will appreciate that other methods of bonding may be accomplished, without departing from the spirit and scope of the present invention.

One example of an anisotropic elastomeric fibrous webbing formed by extrusion methods, followed by the deposition of the extruded threads onto a surface, is disclosed in U.S. Pat. No. 5,385,775, from which FIGS. 1 and 2 were obtained and whose teachings are incorporated herein by reference. The disclosed example describes a meltblowing die arrangement with two separate dies—one for forming the filaments, the other for forming the fibers. The dies extend across a foraminous collecting surface in a direction substantially transverse to the direction of movement of the collecting surface. The extruded threads are deposited onto the collecting surface, with the filament-forming die positioned first so that the filaments form prior to the deposition of the elastomeric fibers onto them. Because the dies deposit the extruded threads in a molten or semi-molten state, the fibers blend with the filament and solidify, bonding at least partially autogenously. The addition of a compatible tackifying resin to the extrudable elastomeric fiber composition, with examples of tackifying resins, is also discussed.

FIG. 1 is a 24.9 X photomicrograph of an exemplary anisotropic elastic fibrous web. FIG. 1 shows substantially parallel rows of continuous filaments covered by a layer of meltblown fibers. The substantially parallel rows of filaments run from the top of the photo to the bottom of the photo.

Figure 2:
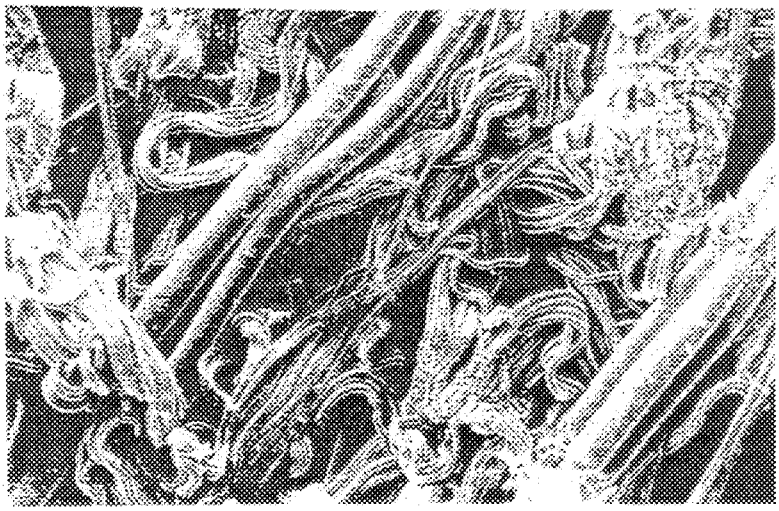
FIG. 2 is a photomicrograph of an exemplary anisotropic elastic fibrous web which is a component of the composite elastic material of the present invention.

FIG. 2 is a 24.9 X photomicrograph of an exemplary anisotropic elastic fibrous web which shows a flip-side of the material shown in FIG. 1. The substantially parallel rows of continuous filaments rest upon a layer of meltblown fibers.

The gatherable layers of the composite elastic material may be manufactured by any process that produces a material that is gatherable and can be joined to the anisotropic elastic fibrous webbing in a manner that maintains the anisotropic elastic nature of the webbing. Examples of such processes include meltblowing, spunbonding or film extrusion processes, but numerous methods for manufacturing a suitable gatherable material exist, as one skilled in the art will appreciate.

The method of forming the composite elastic material substantially comprises joining at least one layer of the anisotropic elastic fibrous webbing to at least one layer of the gatherable material at at least two locations while the webbing is maintained in a desired stretched condition, the desired degree of stretching achievable by the application of an appropriate tensioning force. Joining of the anisotropic elastic webbing and the gatherable material may be produced by any suitable means, including the application of heat and/or pressure to the portions of the layers to be joined.

For example, joining by the application of heat may be produced by overlaying the anisotropic elastic fibrous webbing onto the gatherable layers and heating the desired portions of the layers to at least the softening temperature of the material with the lowest softening temperature to form a reasonably strong and permanent bond between the re-solidified softened portions of the anisotropic elastic fibrous webbing and the gatherable layers.

The temperature to which the materials, or at least the bond sites thereof, are heated for bonding will depend not only on the temperature of the heat source but also on the residence time of the materials on the heated surfaces, the compositions of the materials, the basis weights of the materials and their specific heats and thermal conductivities. For a given combination of materials, the conditions necessary to achieve satisfactory bonding in thermal bonding processes can be readily determined by one skilled in the art.

An exemplary process for forming an anisotropic elastic fibrous web, this process utilizing applied pressure as well as applied heat, is disclosed in U.S. Pat. No. 5,385,775, in which reference was previously made.

The cover material may be made from any material and by any method that renders it effective for its designed purpose, which is to prevent the spread of a particular contaminant or contaminants to and from the wearer's face. For example, for surgical masks, the cover material portion may comprise cotton, rayon, linen, paper, one or more polymeric materials, such as polypropylene, polyurethane or polyethylene, one or more other fibrous materials, or a combination of any of these. The cover material may be a woven or nonwoven fabric, including gauze, mesh, foam, film, or a combination of any of these. The cover material may also be thermoplastic. In addition, the cover material may include particles or layers forming molecular sieves, absorbents, or adsorbents disposed on either the inside or the outside of the mask and having an affinity for a particular compound, so as to further prevent the particular compound from entering or exiting the mask. For example, in order to prevent the mask wearer's exposure to nitrous oxide, an anesthetic, the mask may contain an outer layer of silicalite or certain zeolite particles that have an affinity for nitrous oxide.

The method of making the cover material may include, for example, meltblowing, spunbonding, or other extrusion techniques, followed by wholly or partially autogenous bonding or nonautogenous bonding of the various fabrics and fibers comprising the cover material. Non-autogenous or partially autogenous bonding may be accomplished, for example, by applying heat or pressure to the desired bonding sites. Bonding may also be accomplished by adding one or more binders, tackifying resins or adhesives to the materials comprising the cover. A suitable thermoplastic binder, for example, is an emulsion polymerized self-curing acrylic binder.

Figure 3:
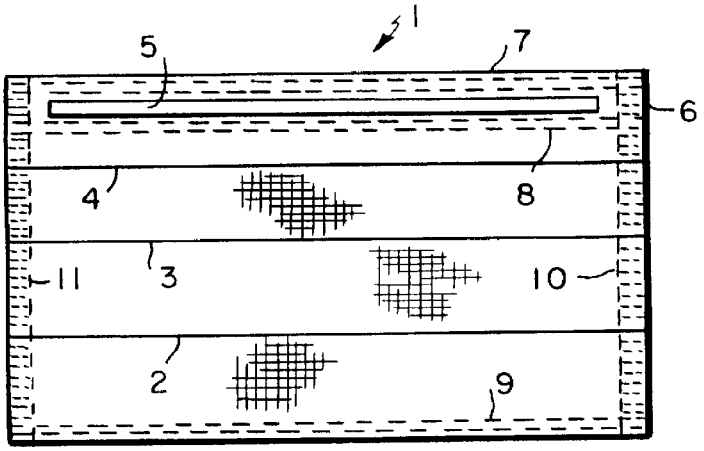
FIG. 3 illustrates a planar view of an exemplary portion of the face mask designed for disposal over the mouth and nostrils of the wearer.

A specific embodiment of an exemplary portion of the face mask of the present invention is illustrated in FIG. 3. In this illustration, the cover material portion is shown in planar view. A substantially rectangular cover material 1 is adapted for disposal over the nostrils and mouth of the wearer to prevent the spread of contaminants to and from the wearer's nostrils and mouth. Pleats 2, 3, and 4 formed into the cover material 1 allow the cover material to expand over the wearer's nose and mouth. A semi-rigid member 5 for bending over the bridge of the wearer's nose and molding against the wearer's facial features, thereby forming a seal as an additional measure to prevent the spread of contaminants, is disposed adjacent to the top edge 6 of the cover material 1. The top edge 6 of the cover material 1 is folded over the semi-rigid member 5 and attached to the surface thereof by seams 7 and 8, thereby enclosing the semi-rigid member within the fabric of the cover material. As a means of reinforcing the edges of the cover material 1, a bottom seam 9 and right and left seams 10 and 11 are also formed around the edges. One skilled in the art will appreciate, however, that various means of attachment and various means of reinforcement may be utilized, without departing from the spirit and scope of the invention, for example, stitching, stapling, applying adhesive, ultrasonic welding, thermal bonding and solvent bonding.

Figure 4:
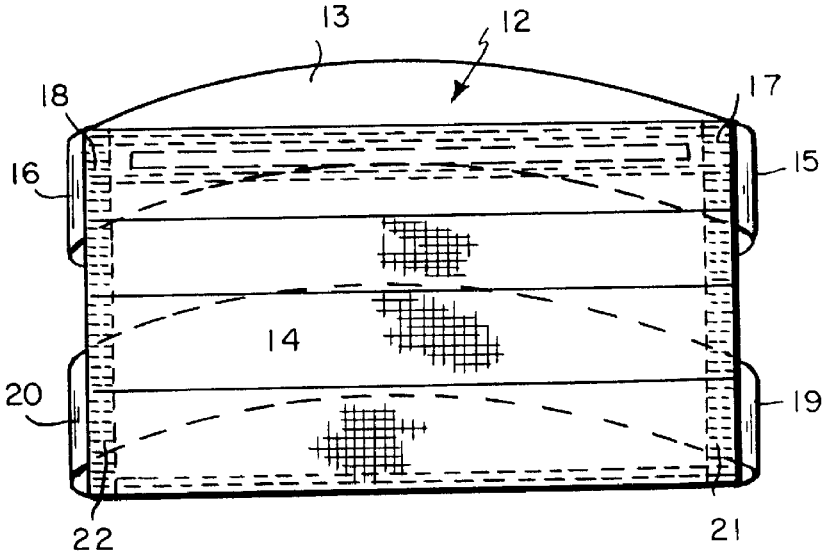
FIG. 4 illustrates a planar view of the face mask designed for disposal over the mouth and nostrils of the wearer.

FIG. 4 illustrates a planar back view of the face mask designed for disposal over the mouth and nostrils of the wearer. In this embodiment, a substantially rectangular cover material 12 is secured to the wearer's face by first and second headbands 13 and 14, formed from the composite elastic material. The first headband 13 has right and left ends 15 and 16 that attach to the upper right and upper left sides 17 and 18 of the cover material 12, so as to encircle the wearer's head, thereby securing the cover material 12 to the wearer's face. The second headband 13 has right and left ends 19 and 20 that attach to the lower right and lower left sides 21 and 22 of the cover material 12, so as to encircle the wearer's head in an arrangement substantially parallel to the first headband 13, thereby further securing the cover material 12 to the wearer's face.

Figure 5:
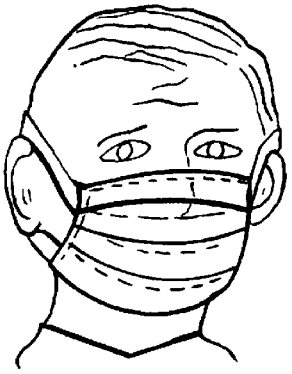
FIG. 5 illustrates a front view of the face mask disposed on the wearer.

FIG. 5 illustrates a front view of the face mask of FIG. 4 disposed on the wearer.

Figure 6:
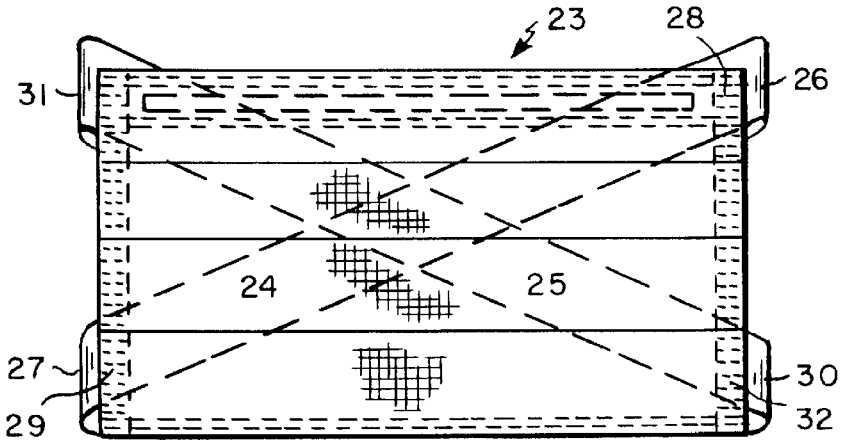
FIG. 6 illustrates a back view of the face mask designed for disposal over the mouth and nostrils of the wearer, wherein the face mask is an alternative embodiment.

FIG. 6 illustrates a planar back view of the face mask designed for disposal over the mouth and nostrils of the wearer, wherein the face mask is an alternative embodiment. In this embodiment, a cover material 23 is secured to the wearer's face by first and second headbands 24 and 25, formed from the composite elastic material. The first headband 24 has right and left ends 26 and 27 that attach to the upper right and lower left sides 28 and 29, respectively, of the cover material 23. The second headband 25 has right and left ends 30 and 31 that attach to the lower right and upper left sides 32 and 33, respectively, of the cover material 23. The first and second headbands 24 and 25, attached to the sides of the cover material, thus criss-cross each other in the center, thereby further securing the cover material 23 to the wearer's face.

Figure 7:
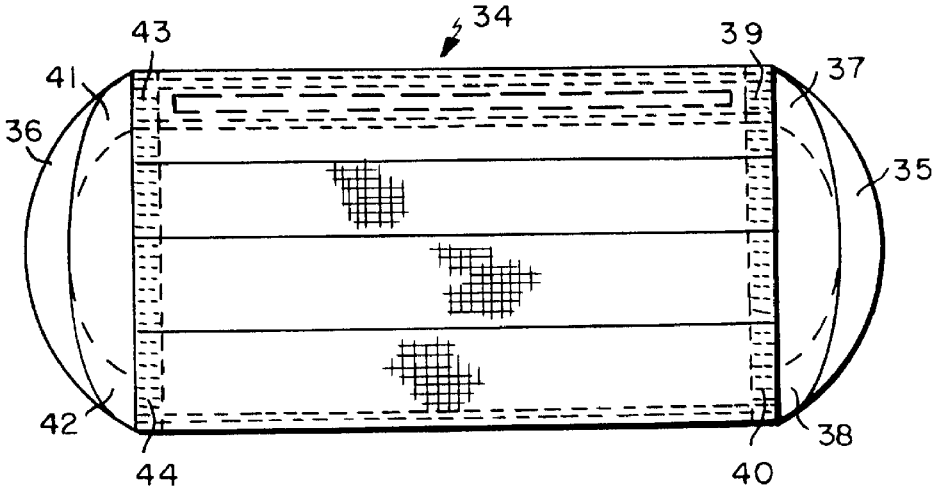
FIG. 7 illustrates a back view of the face mask designed for disposal over the mouth and nostrils of the wearer, wherein the face mask is an alternative embodiment.

FIG. 7 illustrates a planar back view of the face mask designed for disposal over the mouth and nostrils of the wearer, wherein the face mask is an alternative embodiment. In this embodiment, a substantially rectangular cover material 34 is secured to the wearer's face by right and left ear loops 35 and 36, formed from the composite elastic material. The right ear loop 35 has first and second ends 37 and 38 that attach to the upper right and lower right side 39 and 40 of the cover material 34, so as to firmly, yet comfortably, encircle the wearer's right ear. The left ear loop 36 has first and second ends 41 and 42 that attach to the upper left and lower left side 43 and 44 of the cover material 34, so as to firmly, yet comfortably, encircle the wearer's left ear.

Figure 8:
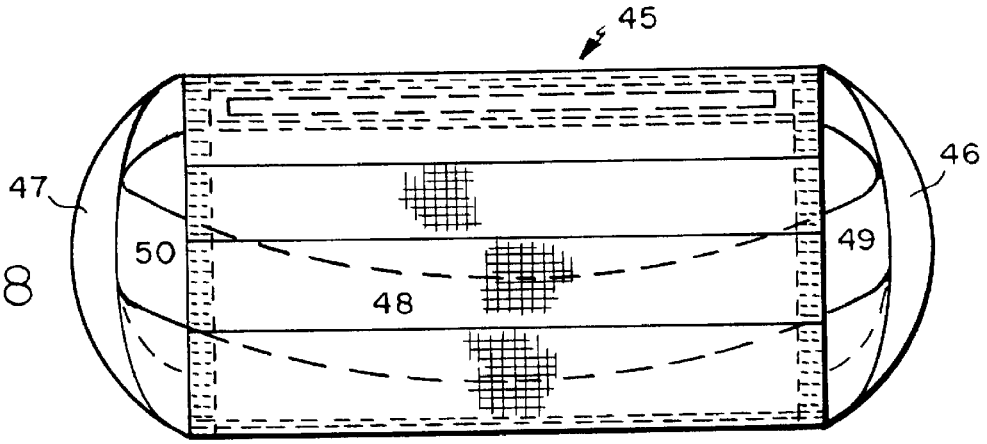
FIG. 8 illustrates a back view of the face mask designed for disposal over the mouth and nostrils of the wearer, wherein the face mask is an alternative embodiment.

FIG. 8 illustrates a planar back view of the face mask designed for disposal over the mouth and nostrils of the wearer, wherein the face mask is an alternative embodiment. In this embodiment, a cover material 45 is secured to the wearer's face by right and left ear loops 46 and 47, formed from the composite elastic material, as described in the above example and illustrated in FIG. 7. In addition to the right and left ear loops 46 and 47, a third band 48 formed from the composite elastic material, having right and left ends 49 and 50, is utilized to further secure the mask to the wearer's face. The right and left ends 49 and 50 attach to the right and left ear loops 46 and 47, respectively, so as to partially encircle the back center portion of the wearer's head, thereby securely attaching the mask to the wearer's face. In this embodiment, the third band 48 pulls the ear loops 46 and 47 slightly away from the back of the wearer's ears, toward the back of the head.

The bands for attaching the cover material to the wearer's face are made by cutting the composite elastic material into widths and lengths appropriate for securing the cover material with a firm, yet comfortable tensioning force. Numerous methods exist for attaching the bands to the cover material. These methods include the use of adhesive, stitching, stapling, thermal bonding, solvent bonding, ultrasonic welding, and incorporating an intermediate fastener between the composite elastic material and the mask, such as velcro, snaps or buttons. Bands may also be welded to the elastic material between the layers of the cover material, where the cover material comprises more than one layer of the composite elastic material. Furthermore, two outer weldable layers may enclose an inner non-weldable layer and yet be fastened by a welding "through" process. This requires the inner layer to either be obliterated or moved aside so that the two outer layers are in contact and welded to each other.

Although several embodiments have been described in detail, it should be understood that various changes, substitutions, and alterations of materials or methods can be made therein without departing from the spirit and scope of the invention as defined by the following claims.

What is claimed is:

1. A face mask, comprising:

a cover material dimensioned to substantially cover a portion of a face of a wearer, the cover material having a top and a bottom side and a right and a left side; and at least one band having a first end and a second end, wherein the first end is attached to one side of the cover material and the second end is attached to the opposite side of the cover material and wherein the band is made of a composite elastic material comprising:

an anisotropic elastic fibrous webbing and a gatherable material, with at least one layer of the gatherable material joined to at least one layer of the anisotropic elastic fibrous webbing at spaced-apart locations so that the gatherable layer is gathered between the spaced-apart locations.

2. The mask of claim 1, wherein the at least one band comprises two bands adapted to encircle a portion of the face of a wearer, the two bands being attached to the cover material so that the two bands are substantially parallel to each other.

3. The mask of claim 1, wherein the at least one band comprises two bands adapted to encircle a portion of a wearer's face, the two bands being attached to the cover material so as to criss-cross each other.

4. The mask of claim 2 or 3, wherein the two bands are ultrasonically welded to the cover material.

5. The mask of claim 2 or 3, wherein the two bands are attached to the cover material by an attachment device selected from the group consisting of stitches, staples, adhesives and intermediate fasteners disposed between the first of the two bands and the cover material and the second of the two bands and the cover material.

6. The mask of claim 1, wherein the at least one band is ultrasonically welded to the cover material.

7. The mask of claim 1, wherein the at least one band is attached to the cover material by an attachment device selected from the group consisting of stitches, staples, adhesives and intermediate fasteners disposed between the at least one band and the cover material.

8. A face mask, comprising:

a cover material dimensioned to substantially cover a portion of a face of a wearer, the cover material having a top and a bottom side and a right and a left side, the right and left side each having an upper portion and a lower portion; and a first band having a first end and a second end, the first end of the first band is attached to the upper portion of the left side of the cover material and the second end is attached to the lower portion of the left side of the cover material; and a second band having a first end and a second end, the first end of the second band is attached to the upper portion of the right side of the cover material and the second end is attached to the lower portion of the right side of the cover material, wherein the first band and the second band are made of a composite elastic material comprising:

an anisotropic elastic fibrous webbing and a gatherable material, with at least one layer of the gatherable material joined to at least one layer of the anisotropic elastic fibrous webbing at spaced-apart locations so that the gatherable layer is gathered between the spaced-apart locations.

9. The mask of claim 8, wherein the first band and the second band are adapted to loop around a wearer's ears, thereby securing the mask to a wearer's face.

10. The mask of claim 9 further comprising a third band having a first end and a second end, the first end of the third band is attached to the first band at a location proximally at the center point of the first band, the second end of the third band is attached to the second band at a location proximally at the center point of the second band, so as to secure the face mask against a wearer's face.

11. The mask of claim 10, wherein the first band and the second band are ultrasonically welded to the cover material and to the third band.

12. The mask of claim 10, wherein the first band and the second band are attached to the third band and to the cover material by attachment devices selected from the group consisting of stitches, staples, adhesives and intermediate fasteners disposed between the bands and the cover material.

13. The mask of claim 7 or 12, wherein the intermediate fasteners are selected from the group consisting of stitches, staples, adhesives, velcro, snaps and buttons.

14. The mask of claim 1, 2, 3, or 9, wherein the dimensioned cover material has a shape selected from the group consisting of substantially rectangular, substantially square, substantially oval and substantially round.

15. The mask of claim 1, 2, 3, or 9, wherein the dimensioned cover material is adapted to cover a portion of a wearer's face selected from the group consisting of a wearer's eyes, nostrils and mouth.

16. The mask of claim 1, 2, 3, or 9, wherein a portion of the cover material is selected from the group consisting of cotton, rayon, linen, paper, fibrous material, and polymeric material.

17. The mask of claim 1, 2, 3, or 9, wherein a portion of the cover material comprises a polymeric material selected from the group consisting of polypropylene, polyurethane and polyethylene.

18. The mask of claim 1, 2, 3, or 9, wherein the cover material has a structure selected from the group consisting of mesh, foam, and film.

19. The mask of claim 1, 2, 3, or 9, wherein the cover material is thermoplastic.

20. The mask of claim 1, 2, 3, or 9, wherein a layer of particles having an affinity for a particular compound is disposed on the cover material, so that the layer of particles prevents the particular compound from passing through the cover material.

21. The mask of claim 20 wherein the layer of particles is selected from the group consisting of absorbents or adsorbents.

22. The mask of claim 1, 2, 3, or 9, in which the cover material contains an at least one pleat formed therein, wherein the at least one pleat is adapted to expand the cover material when worn.

23. The mask of claim 1, 2, 3, or 9, wherein the top side of the cover material includes a semi-rigid member adapted for molding against a wearer's facial features, thereby conforming the cover material to a wearer's face.

24. The mask of claim 1, 2, 3, or 9, wherein the cover material further comprises reinforcing seams around a perimeter of the cover material.

25. The mask of claim 1, 2, 3, or 9, wherein the gatherable material further comprises a nonwoven material selected from the group consisting of spunbonded fibers, meltblown fibers, and a bonded carded web of fibers.

26. The mask of claim 25, wherein the gatherable material further comprises a material selected from the group consisting of wood pulp, staple fibers, superabsorbent materials, and particulates.

27. The mask of claim 8 or 9, wherein the first band and the second band are ultrasonically welded to the cover material.

28. The mask of claim 8 or 9, wherein the first band and the second band are attached to the cover material by an attachment device selected from the group consisting of stitches, staples, adhesives and intermediate fasteners disposed between the first band and the cover material and the second band and the cover material.

29. A face mask, comprising:

a cover material dimensioned to substantially cover a portion of a face of a wearer, said cover material having a top side, a bottom side, a right side and a left side; and at least one band having a first end and a second end, wherein said first end is attached to one side of said cover material and said second end is attached to the opposite side of said cover material and wherein said at least one band is made of an anisotropic elastic fibrous webbing.

* * * * *